US005282569A

United States Patent [19]

Kiyota

[11] Patent Number: 5,282,569

[45] Date of Patent: Feb. 1, 1994

[54] RAILROAD CROSSING STRUCTURE

[75] Inventor: Minoru Kiyota, Osaka, Japan

[73] Assignee: Kiyota Railway Engineering Co., Ltd., Osaka, Japan

[21] Appl. No.: 927,970

[22] Filed: Aug. 11, 1992

[51] Int. Cl.[5] ..... E01C 9/04

[52] U.S. Cl. ..... 238/8

[58] Field of Search ..... 238/2, 3, 5, 6, 7, 8, 238/9; 404/32-36, 40, 41, 45

[56] References Cited

U.S. PATENT DOCUMENTS

| | | | |
|---|---|---|---|
| 1,411,415 | 4/1922 | Cooley | 238/8 X |
| 2,828,079 | 3/1958 | Rennels | 238/8 |
| 3,843,051 | 10/1974 | Whitlock | 238/8 |
| 3,866,830 | 2/1975 | Hein et al. | 238/8 |
| 4,009,827 | 3/1977 | Tafel | 238/8 |
| 4,117,977 | 10/1978 | Whitlock | 238/8 |
| 4,880,158 | 11/1989 | Cook | 238/8 |
| 5,201,467 | 4/1993 | Kennel et al. | 238/8 |

FOREIGN PATENT DOCUMENTS

| | | | |
|---|---|---|---|
| 2350759 | 4/1975 | Fed. Rep. of Germany | 238/8 |
| 0650541 | 7/1985 | Switzerland | 238/8 |
| 9115631 | 10/1991 | World Int. Prop. O. | 238/8 |

*Primary Examiner*—Frank E. Werner
*Assistant Examiner*—Scott L. Lowe
*Attorney, Agent, or Firm*—Wenderoth, Lind & Ponack

[57] ABSTRACT

A railroad crossing structure has a plurality of paving plates placed between a pair of rails of a railway track, with the opposed front and rear ends of the adjacent paving plates supported on the sleepers of the track and abutting each other. Each paving plate has a rubber covering, and a plurality of hollow steel pipes arranged in such a way as to bear a predetermined load and embedded in the rubber. Projections provided at both sides of each paving plate are engaged in the recessed portions of the rails. The projections are formed with holes extending parallel to the rails and fitted with packings. Further, a plurality of second paving plates are placed at the outer sides of the pair of rails. They are arranged in the same manner and have the same construction as those placed between the rails. Each of the second paving plates has a projection provided at one side thereof near the respective rail and engaged with the rail.

3 Claims, 6 Drawing Sheets

RAILROAD CROSSING STRUCTURE

BACKGROUND OF THE INVENTION

This invention relates to a railroad crossing structure made of reinforced concrete (RC) plates which can be built or repaired in a long-rail track without the need for cutting and reconnecting the rails or changing the setting of the rails.

When constructing a rigid crossing structure in a long-rail track, it was heretofore necessary to cut and reconnect the rails and change the setting of the long rails.

One problem with a conventional crossing structure, which is constructed of prestressed concrete (PC) sleepers and RC plates, is that its design load is only two tons, which is enough to bear the weight of people and light-weight vehicles but not enough to bear the weight of heavier vehicles, e.g. those weighing 20 tons.

Further, if packings are interposed between the recessed portion of the rails and the paving plates in order to prevent the paving plates from floating or if the paving plates are made of rubber, their ends have to be jammed into the recessed portion while twisting them by use of a jig. Then, by removing the twisting force, the ends of the paving plates are brought into engagement with the recessed portion of the rails with their own resilient restoring force. Such an arrangement involves assembling parts for preventing the paving plates from floating and the use of a jig.

SUMMARY OF THE INVENTION

It is an object of this invention to provide a crossing structure which can be constructed easily without the need for cutting and reconnecting rails and changing the setting of rails.

In accordance with the present invention, the packings inserted in the holes formed in the projections of the paving plates provided between and outside the rails serve to keep these projections firmly engaged in the recessed portions of the rails and thus to prevent the paving plates from getting out of position.

In another arrangement, a single strong pipe is inserted into the through-holes formed in the projections of the paving plates outside the rails. Then butt plates are brought into abutment with the outer end surfaces of the paving plates and the end faces of the pipe. Finally, both butt plates are pulled together to join the ends of the paving plates outside the rails.

In another embodiment, the conventional PC sleepers are replaced with reinforced concrete foundation plates. The paving plates are laid on the foundation plates between and outside the rails. Thus, there is no need for connecting and reconnecting long rails or changing their setting.

The crossing structure according to this invention can be constructed easily without the need for connecting and reconnecting rails or changing the setting of rails.

Further, since the paying plates provided between and outside the rails comprise hollow steel pipes and a rubber covering enclosing the steel pipes, heavy vehicles can pass thereover. Also since they are lightweight, no heavy machinery is necessary for constructing the crossing.

The projections of the paving plates are engaged in the recessed portions of the rails with the packings inserted in the holes in the projections. They can be firmly engaged in the recessed portions of the rails. This serves to prevent the paving plates from floating.

Further, the paving plates can be easily removed for repair if there is a dimensional error. The paving plates thus repaired can be reused.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

First Embodiment

Figure 1:
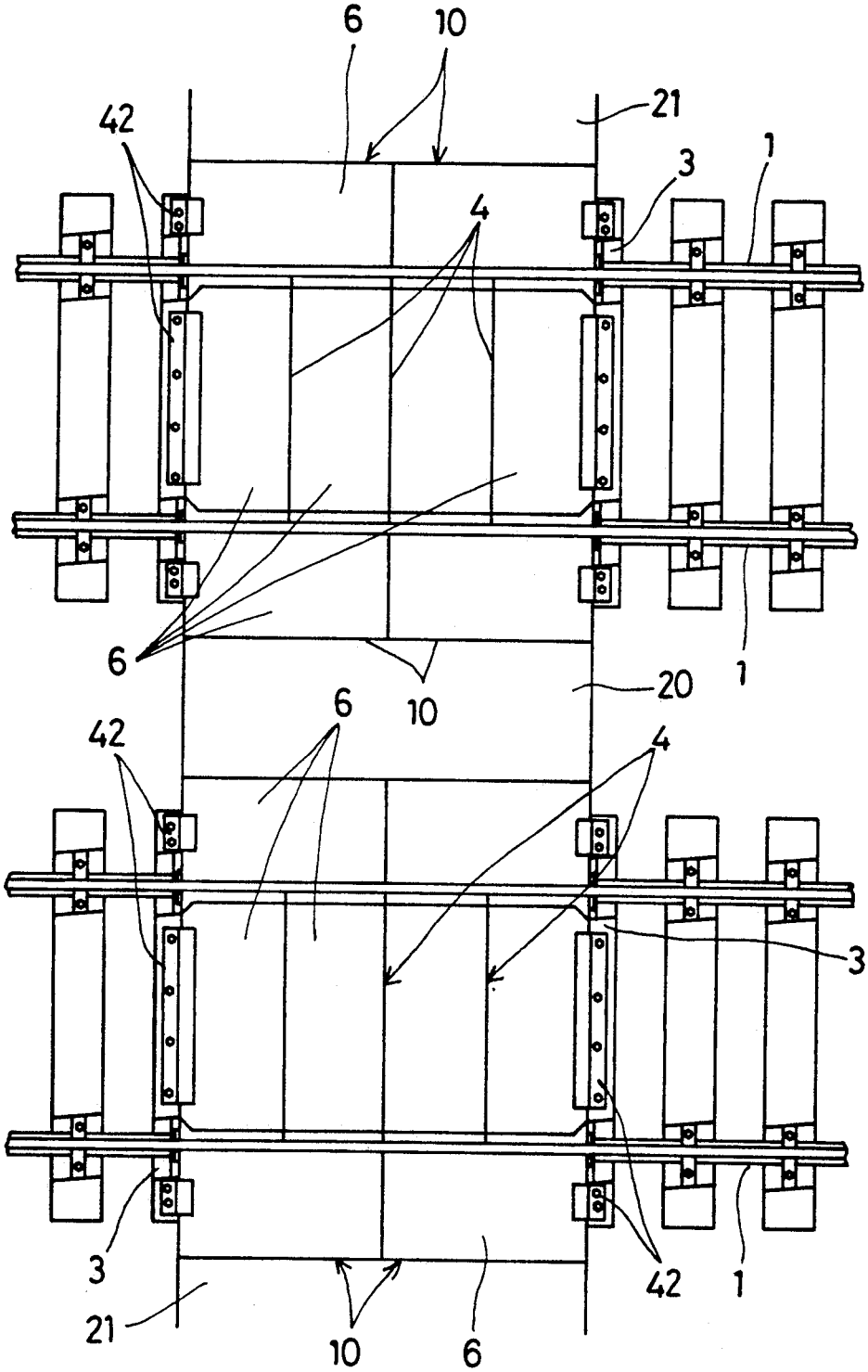
FIG. 1 is a plan view of the first embodiment of this invention.

As shown in FIGS. 1–5, a plurality of paving plates 4 are arranged in a row between rails 1. They have both front and rear ends thereof supported on sleepers of prestressed concrete (PC) and both sides thereof engaged in the recessed portions of the rails 1.

Each paving plate 4 comprises hollow steel pipes 5 and 5' arranged so as to bear a predetermined load and a rubber covering 6 completely surrounding the steel pipes 5 and 5' and is in the form of a square plate as a whole.

As shown in FIGS. 2–5, each paving plate 4 includes two pairs of long steel pipes 5' extending over the adjacent PC sleepers 3, each pair thus being located to one side of the longitudinal centerline of the plate and having such a length that both closed ends of the pipes 5' thereof will be located just short of the end of the paving plate 4. A plurality of short steel pipes 5 (both ends closed) extend above the long steel pipes 5' with their ends aligned with ends of the short steel pipes 5. However, the pipes may be arranged in any other way.

The paving plates 4 are provided at both ends thereof with projections 7 integral with the rubber covering 6 and inserted in the recessed portions of the rails 1. Each projection 7 is formed with a hole 8 extending parallel to the rails 1 from both end faces thereof halfway inside or extending through the plate between the end faces. A packing such as a pipe 9 made of synthetic resin is inserted in the hole or holes 8 to prevent the deformation of the projections 7. This ensures that the projections 7 will engage the recessed portions of the rails 1, thus preventing the paving plates 4 from floating up and getting out of position.

Outside the rails 1, a plurality of paving plates 10 are provided with the front and rear edges thereof supported on the PC sleepers 3 and in abutment with the edges of the adjacent paving plates. Further they have one end thereof engaged in the recessed portions of the rails 1 and the other end placed on the track bed 2.

As with the paving plates 4, each paving plate 10 comprises hollow steel pipes 5 arranged so as to bear a predetermined load and a rubber covering 6 completely surrounding the steel pipes 5 and is in the form of a square plate as a whole.

Each paving plate 10 is formed at one end thereof with a projection 11 adapted to be engaged in the recess in the respective rail 1.

Each projection 11 is formed with a through hole 12 extending parallel to the rails 1. A strong pipe 13 such as a steel pipe is inserted into each hole 12 so as to fill the entire length thereof. A pair of butt plates 14 are provided in abutment with the respective end faces of the pipe 13 and the outer end surfaces of the paving plates 10 adjacent the end faces of the pipe 13. Then the butt plates 14 are pulled together by a clamping means 15 to make the ends of the paving plates 10 flush with each other and at the same time to prevent them from partially floating. Also, this serves to reliably keep the rails 1 and the projections 11 engaged with each other.

In this embodiment, the clamping means 15 comprises a threaded shaft 16 extending through the pipe 13 and nuts 17 threaded on the threaded shaft 16 at both ends thereof.

Figure 2:
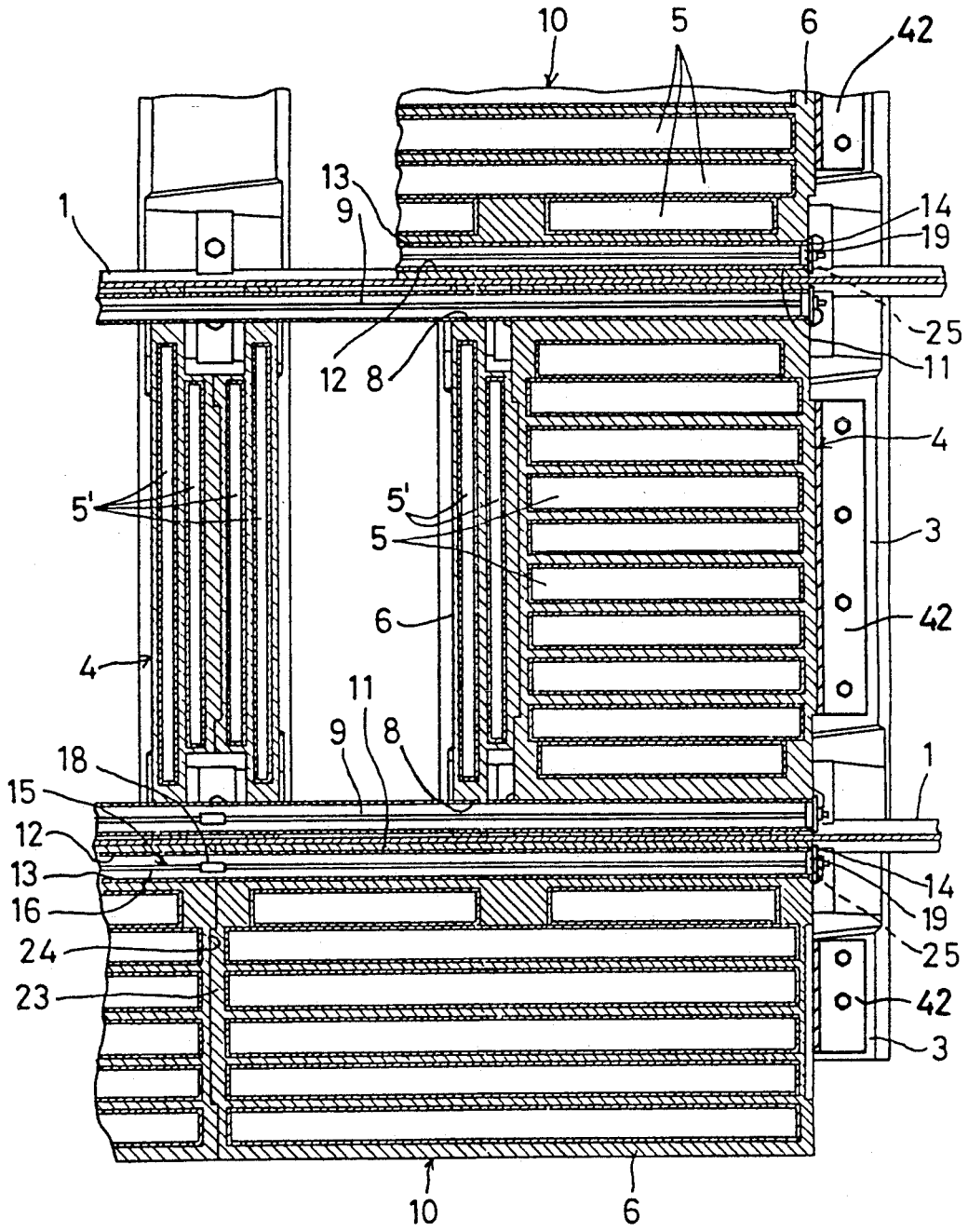
FIG. 2 is a partially cutaway enlarged view of a portion of the same.
Figure 3:
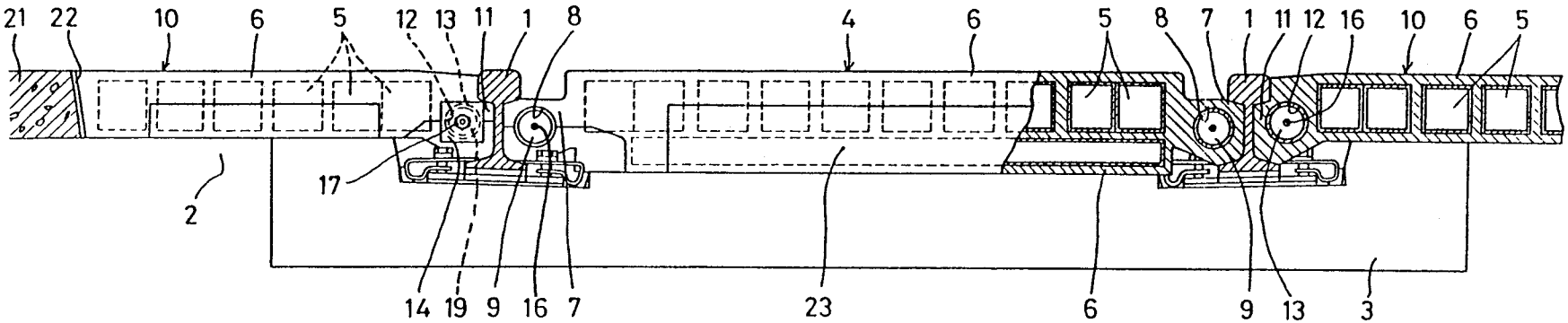
FIG. 3 is a side view, partially in section, of the same.

The same clamping means 15 is provided for the pipe 9, too, shown in FIGS. 2 and 3.

In the figures, numeral 18 designates an internally threaded pipe for connecting two segments of the threaded shaft 16 together. Each butt plate 14 is provided on its inner side with an engaging portion 19 engaged in the pipe 13. The space between the opposed ends of the paving plates 10 is filled with asphalt 20. Numeral 21 designates asphalt of the road, 22 a partitioning plate, and 25 a hole through which the threaded shaft 16 extends.

The paving plates are prevented by clamping members 42 from moving in any direction, the clamping members being secured to the sleepers 3.

Figure 5:
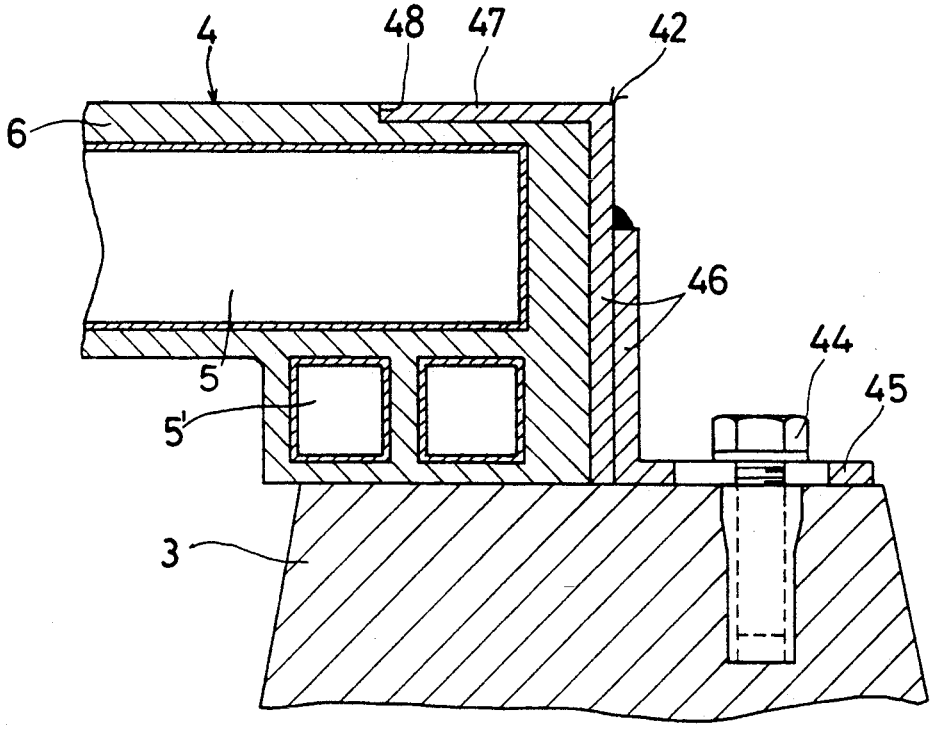
FIG. 5 is a vertical sectional front view of the fastening member.

As shown in FIG. 5, each clamping member 42 comprises a seating plate 45 secured to the sleeper 3 by means of a bolt 44, an upright plate 46 extending vertically from the seating plate 45 and a horizontal plate 47 integral with the upright plate 46 and extending therefrom to one side. The horizontal plate 47 is fitted in a stepped recess 48 formed in the rubber covering 6 across the top side thereof, with its leading edge and side edges abutting the respective edges of the covering defining the recess 48, so as not to be an obstacle to pedestrians.

Second Embodiment

Figure 6:
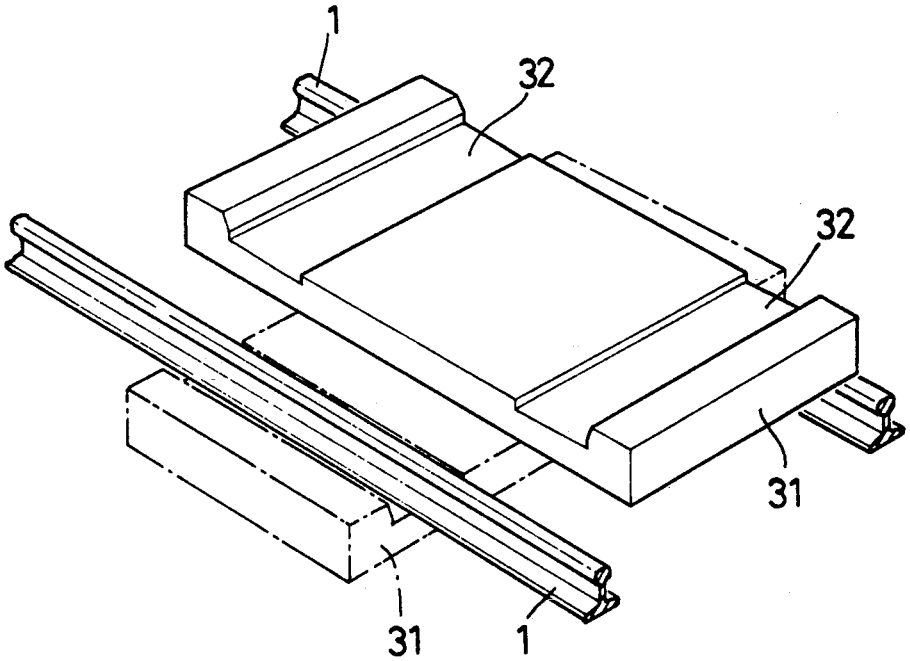
FIG. 6 is a perspective view showing how the foundation plates of a second embodiment are inserted.
Figure 7:
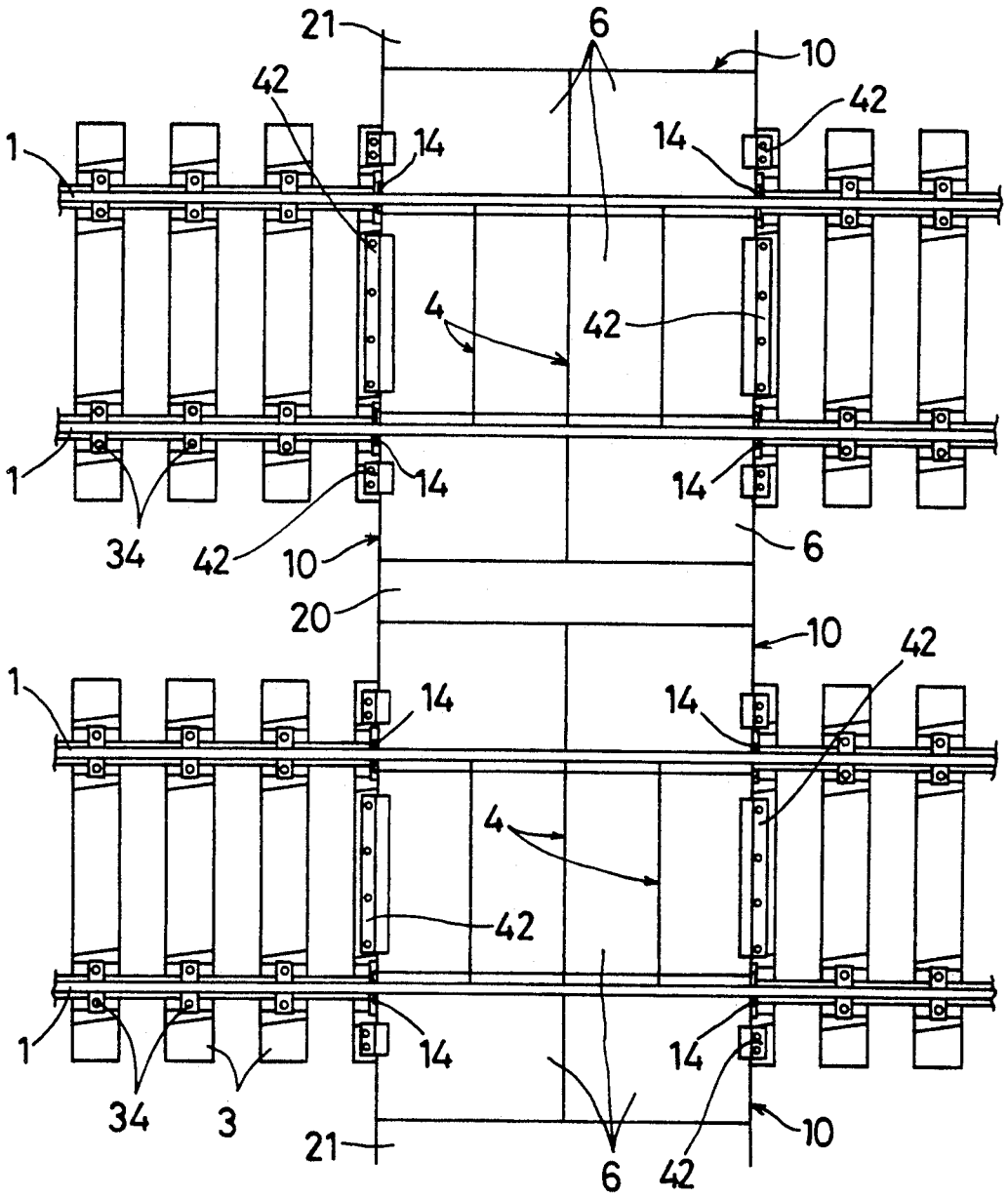
FIG. 7 is a plan view of the second embodiment.
Figure 8:
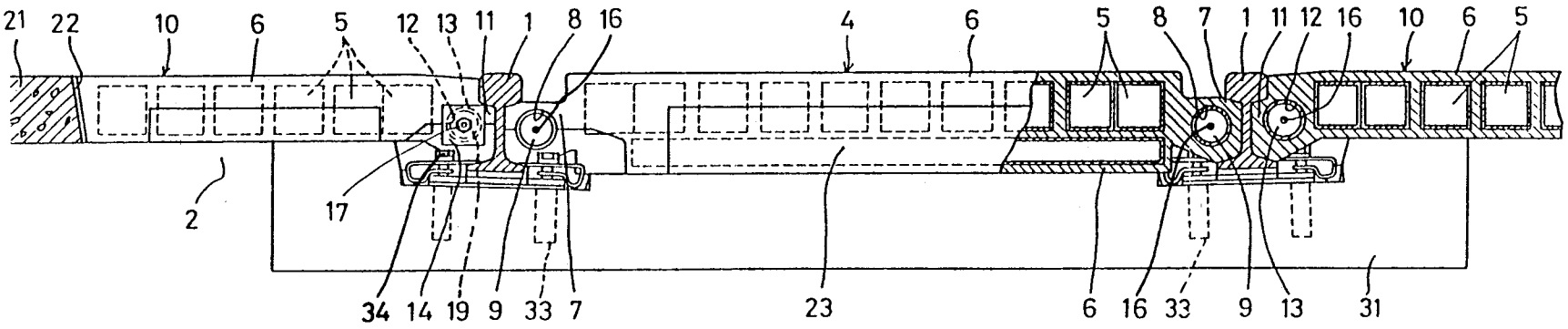
FIG. 8 is a side view, partially in section, of the same.

In the crossing structure shown in FIGS. 6–8, the sleepers 3 within the crossing site are replaced with foundation plates 31 made of reinforced concrete.

For this purpose, gravel left after the sleepers have been removed has to be removed. Then, the foundation plates 31 are placed between the rails 1 as shown by solid lines in FIG. 6 and turned by 90 degrees so as to be located under the rails 1 as shown by chain lines.

In this state, the rails 1 are fitted in grooves 32 formed in the top surface of the foundation plates 31 by threading bolts of clamping fittings 34 into nuts 33 buried in the bottom of the groove 32.

The same paving plates 4 as those of the first embodiment are placed on the foundation plates 31 between the rails 1 in the same manner as in the first embodiment. Also, the same paving plates 10 as used in the first embodiment are placed outside of the rails 1 in the same manner as in the first embodiment.

Figure 4:
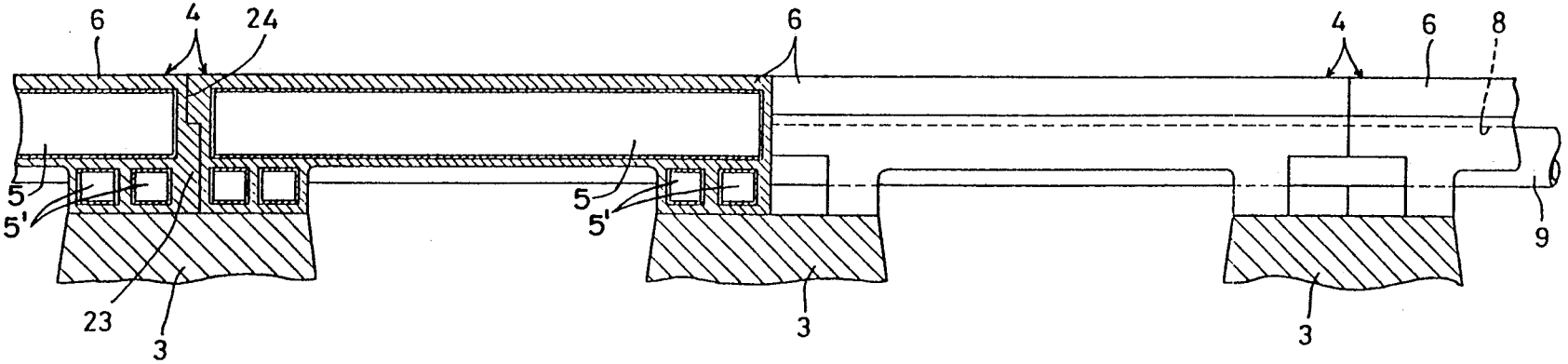
FIG. 4 is a partially cutaway front view of the same.

As shown in FIGS. 2 and 4, the paving plates 10 and 4 may have their mating surfaces stepped as at 23 and 24 so that they can be joined together in an optimum way.

In this embodiment, the clamping members 42 are secured to the foundation plates of concrete.

What is claimed is:

1. Railroad crossing structure comprising: a plurality of first paving plates interposed between rails of a railway track, each of said first paving plates comprising a rubber covering and a plurality of hollow steel pipes embedded in said covering and arranged to bear a predetermined load, each of said first paving plates having front and rear ends supported on the track, the ends of said paving plates also abutting one another, and each of said first paving plates having projections at opposite sides thereof engaged with recessed portions of said rails, respectively, the projections of said first paving plates having holes therein extending longitudinally in alignment with one another in a direction parallel to the rails at each of the sides of the first paving plates; pipes removably fitted to and coupling said first paving plates and extending through the aligned holes in said projections of the first paving plates at each of said sides of the paving plates, respectively; a plurality of second paving plates disposed outside of the rails, each of said second paving plates comprising a rubber covering and a plurality of hollow steel pipes embedded in said covering and arranged to bear a predetermined load, each of said second paving plates having front and rear ends supported on the track, the ends of said second paving plates also abutting one another, each of said second paving plates having a projection at one side thereof engaged with a recessed portion of one of the rails of the track, and the other side of each of said second paving plates remote from said one of the rails being supported on a road bed, the projections of said second paving plates having holes therein extending longitudinally in alignment with one another in a direction parallel to the rails at respective outer sides of each of the rails; and pipes removably fitted to and coupling said second paving plates and extending through the aligned holes in said projections of the second paving plates at each outer side of the rails, respectively.

2. A railroad crossing structure as claimed in claim 1, wherein each of said ends of both said first and said second paving plates are supported on sleepers of the railway track.

3. Railroad crossing structure comprising: a plurality of foundation plates each having a pair of grooves at an upper surface thereof, each of said foundation plates supporting both rails of a railway track with the rails received in said grooves, respectively, portions of said foundation plates being located at outer sides of the rails, respectively; a plurality of first paving plates interposed between the rails of the railways track and supported on said foundation plates, each of said first paving plates comprising a rubber covering and a plurality of hollow steel pipes embedded in said covering and arranged to bear a predetermined load, each of said first paving plates having ends abutting one another, and each of said first paving plates having projections at opposite sides thereof engaged with recessed portions of said rails, respectively, the projections of said first paving plates having holes therein extending longitudinally in alignment with one another in a direction parallel to the rails at each of the sides of the first paving plates; pipes removably fitted to and coupling said first paving plates and extending through the aligned holes in said projections of the first paving plates at each of said sides of the paving plates, respectively; a plurality of second paving plates disposed outside of the rails, each of said second paving plates comprising a rubber covering and a plurality of hollow steel pipes embedded in said covering and arranged to bear a predetermined load, each of said second paving plates having front and rear ends supported on said portions of the foundation plates located at outer sides of the rails, the ends of said second paving plates also abutting one another, each of said second paving plates having a projection at one side thereof engaged with a recessed portion of a respective one of the rails of the track, and the other side of each of said second paving plates remote from said respective one of the rails being supported on a road bed, the projections of said second paving plates having holes therein extending longitudinally with one another in a direction parallel to the rails at each of the outer sides of the rails; and pipes removably fitted to and coupling said second paving plates and extending through the aligned holes in said projections of the second paving plates at each outer side of the rails, respectively.

* * * * *